United States Patent [19]

Mowforth et al.

[11] Patent Number: 5,009,991

[45] Date of Patent: Apr. 23, 1991

[54] SILVER HALIDE EMULSIONS CONTAINING TWINNED SILVER HALIDE CRYSTALS

[75] Inventors: Clive W. Mowforth, Kingshill; James F. Bullock, Macclesfield; Trevor J. Maternaghan, Knutsford; Karen N. Harvey, Warrington, all of United Kingdom

[73] Assignee: Ilford Limited, Cheshire, United Kingdom

[21] Appl. No.: 400,659

[22] Filed: Aug. 31, 1989

[51] Int. Cl.[5] ..... G03C 1/02

[52] U.S. Cl. ..... 430/567; 430/569

[58] Field of Search ..... 430/567, 569

[56] References Cited

U.S. PATENT DOCUMENTS 4,184,877 1/1980 Maternaghan ..... 430/569

4,490,458 12/1984 House ..... 430/567

*Primary Examiner*—Paul R. Michl

*Assistant Examiner*—Thomas R. Neville

*Attorney, Agent, or Firm*—Darby & Darby

[57] ABSTRACT

There is described a method of preparing a silver halide emulsion wherein the silver halide crystals are of the twinned type which comprises the steps of (a) providing in a colloid dispersion medium silver halide crystals containing at least 90% iodide and at least 80% of which are hexagonal lattice structure with each displaying predominantly a single basal face, (b) mixing in the dispersing medium containing the sail silver iodide crystals an aqueous solution of an alkali metal of ammonium bromide or chloride (or mixture thereof) so forming twinned silver halide crystals containing iodide and/or the halide or halides being added, optionally (c) adding a silver halide solvent to the dispersing medium and so causing the growth of the twinned silver halide crystals, and optionally (d) then causing the twinned crystals to increase in size by adding to the colloid dispersing medium further aqueous silver salt solution and further alkali metal or ammonium halide and then finally optionally (e) removing the water-soluble salts formed and chemically sensitizing the silver halide crystals.

22 Claims, 4 Drawing Sheets

SILVER HALIDE EMULSIONS CONTAINING TWINNED SILVER HALIDE CRYSTALS

FIELD OF USE IN INVENTION

This invention relates to the production of silver halide emulsions and their use in photographic materials.

BACKGROUND OF THE INVENTION

In British patent specification 1520976 there is described a method of preparing silver halide emulsions wherein the silver halide crystals are of the twinned type. This method involves the formation of seed silver iodide crystals. A soluble silver salt and another halide are added to the silver iodide seed crystals. In a modification to this method in British patent specification 1570581 it is shown that the silver iodide seed crystals formed are of the truncated bi-pyramidal hexagonal lattice habit. When soluble silver and other halide salts are added to the dispersion of the silver iodide seed crystals the silver iodide crystals act as sites for the epitaxial growth of the twinned silver halide crystals. Similar growth of twinned silver halide crystals is shown in British patent specification 1596602.

In the process as described in British patent 1570581 and in British patent 1596602, silver halide crystals of high iodide content are first formed. Silver halide crystals which have a high iodide content, that is to say from 90 to 100 mole % iodide are predominantly of hexagonal lattice structure.

Techniques for the preparation of silver iodide crystals predominantly of hexagonal lattice structure are well-known, and are for example described by B. L. Byerley and H. Hirsch, J. Phot Sci Volume 18 p. 53 (1970). Such crystals have the shape of hexagonal pyramids or bipyramids. The basal faces of these pyramids comprise the lattice planes of the (0001) type. Silver iodide crystals of the hexagonal lattice structure are shown in FIG. 2 of British Pat. No. 1570581.

The disclosures of all documents cited in this specification are incorporated by reference in their entirety.

In the process in Step (b) as set out in No. 1570581 aqueous solutions of a silver salt and an alkali metal or ammonium bromide or chloride (or mixtures thereof) are added to the dispersion medium containing the silver iodide crystals which are predominantly of the hexagonal lattice structure, so that silver iodo-bromide (or iodo-chloride or iodo-chlorobromide) is precipitated. The mixed halide crystals precipitated are of the face centered cubic structure. These crystals incorporate silver iodide from the dissolving seed crystals up to a maximum of approximately 40 mole % of the total halide at a temperature of approximately 65° C. Thus, during this step the first-formed silver iodide crystals dissolve and the silver iodide is incorporated into the growing face-centered cubic lattice crystals. Electron micrographs have revealed that in step (b), whilst no overall circumferential growth of the silver iodide crystals occurs, the face-centered cubic lattice type crystals of the halide being added in step (b) form and grow epitaxially on the basal faces of the silver iodide crystals formed in step (a). Epitaxial growth is possible between (0001) AgI faces and (111) AgBr or AgCl faces because both are hexagonally close-packed, homoionic lattice planes. It has been observed by electron microscopy that the growing epitaxial crystals show are at least about 90% twinned (recognized by the parallel striations characteristic of several twin planes intersecting the surface) while attached to the parent silver iodide crystal. It is believed that this twinning is encouraged by the continuous supply of iodide ions to the growing (face-centered cubic) phase, either by bulk diffusion through the dispersing medium or by anionic diffusion through the crystal junction. In general, one twinned face-centered cubic mixed halide crystal is formed at the single basal face of a hexagonal pyramidal silver iodide crystal, and two twinned mixed halide crystals are formed at the two basal faces of each hexagonal bi-pyramidal silver iodide crystal. FIG. 3 of No. 1596602 shows one hexagonal pyramidal silver iodide crystal (3*a*) and one hexagonal bi-pyramidal crystal (3*b*). As precipitation of the silver halide is continued and the total iodide proportion of the silver halide suspended in the dispersion medium decreases to 30–40 mole % iodide, the dissolution of the originally formed silver iodide crystals becomes predominant and the 'dumb-bell'-shaped crystals of FIG. 4 of No. 1596602 are observed. FIG. 4 shows one twinned face-centered type formed on a hexagonal pyramidal silver iodide crystal (4*a*) and one twinned face-centered cubic crystal formed at each basal face of a hexagonal bi-pyramidal silver iodide crystal (4*b*). As step (b) proceeds the twinned face-centered-cubic mixed halide crystals increase in size and the iodide crystals decrease in size. This stage is shown in FIG. 5 of No. 1596602. Eventually the silver iodide linkage between the two twinned crystals (5*b*) is broken and the two twinned crystals are released.

FIG. 6 of No. 1596602 is an electron micrograph showing the dumb-bell crystal of FIG. 4*b* in the process of recrystallization.

In the process described in No. 1596602 the supply of iodide ions in step (b) hereinafter called the recrystallization step is provided by further dissolution of the silver iodide crystals to maintain the equilibrium concentration given by the relationship:

$$[Ag+][I-]=k$$

where [Ag+], [I−] are the activities (in dilute solution the concentrations) of silver and iodide ions, and k is a constant (k is the well-known solubility product).

As hereinbefore stated, the incorporation of iodide in the growing crystals in step (b) encourages the formation of octahedral faces, and in particular, the formation of stacking faults known as twin planes. Moreover, in one aspect of the method of No. 1596602, the formation of crystals with parallel twin planes is especially favored.

This results in a modification of crystal shape, so that many of the crystals formed are of the tabular twinned type illustrated in FIG. 1 of the foregoing British Patent. It is known that the formation of twin planes is not possible when the external faces of the crystals are the cubic (100) lattice planes (Berry and Skillman, Photographic Science and Engineering 6, page 159 (1962)), but can occur only when the external faces comprise at least partially the octahedral (111) lattice planes. Thus the incorporation of iodide in the recrystallization step (b) has the effect of encouraging twin formation, even under conditions where, with crystals containing no iodide, cubic external faces would normally be displayed.

In step (b) as iodide ions are removed from the solution phase by precipitation, they are rapidly replaced by the dissolution of further silver iodide crystals, so that depending on the addition rates of the silver and halide solutions the silver iodide crystals are completely dissolved by the end of the precipitation or recrystallization step (b).

In No. 1596602 it is shown in FIG. 3 that the silver iodide seed crystals may be in the form of a single hexagonal pyramids or in the form of bi-pyramids. However, it has been found in the preparation of the silver iodide seed crystals described both in No. 1570581 and in No. 1596602 that most of the seed crystals produced are of the bi-pyramidal habit.

SUMMARY OF THE INVENTION

Figure 1:
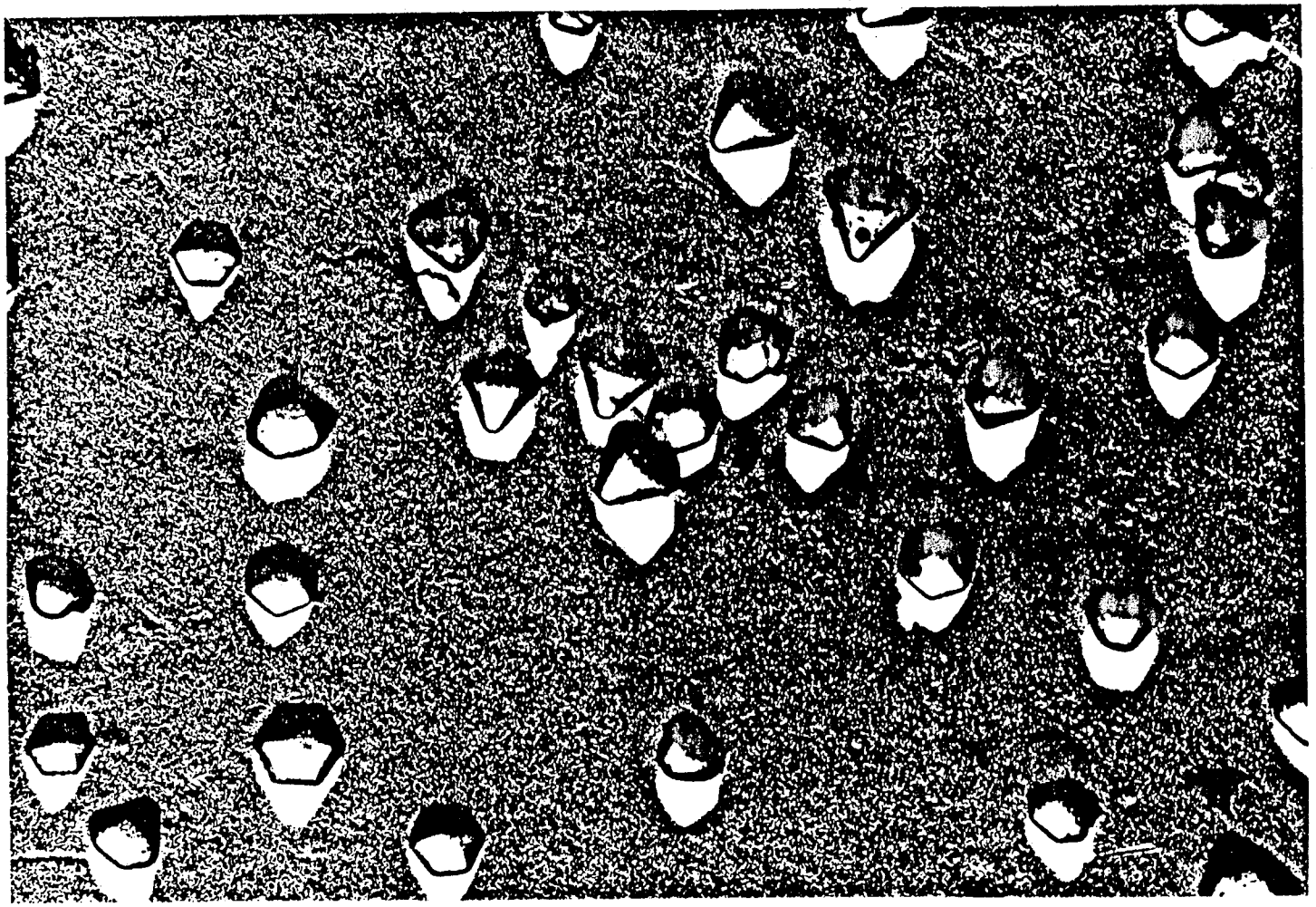
FIG. 1 is an electron micrograph of silver iodide crystals produced in accordance with Example 1, step (a).

We have now found that improved photographic efficiency and/or image quality of the final twinned silver halide emulsions may be obtained if the habit of the silver iodide seed crystals formed in step (a) are predominantly (i.e. at least about 80%) of the single pyramidal type or of a modified pyramidal habit but with a single basal face.

Therefore according to the present invention there is provided a method of preparing a silver halide emulsion wherein the silver halide crystals are of the twinned type which comprises the steps of (a) providing in a colloid dispersing medium silver halide crystals containing at least 90% iodide and at least 80% of which are of hexagonal lattice structure with each displaying predominantly a single basal face, (b) mixing in the dispersing medium containing the said silver iodide crystals an aqueous solution of an alkali metal or ammonium bromide or chloride (or mixture thereof) so forming twinned silver halide crystals containing iodide and the halide or halide being added, optionally (c) adding a silver halide solvent to the dispersing medium and so causing the growth of the twinned silver halide crystals, and optionally (d) then causing the twinned crystals to increase in size by adding to the colloid dispersing medium further aqueous silver salt solution and further alkali metal or ammonium halide and then finally optionally (e) removing the water-soluble salts formed and chemically sensitizing the silver halide crystals.

Usually in step (c) the silver halide crystals are also spectrally sensitized.

At least 80% of the silver iodide crystals used in step (a) have a single basal face and they are predominantly of the single pyramidal habit or of a modified single pyramidal habit but with a single basal face. Preferably the iodide crystals are made in said step (a).

DETAILED DESCRIPTION OF THE INVENTION

The disclosure of all cited patents and other documents is incorporated by reference in its entirety.

Single pyramidal silver iodide crystals have been described in the prior art other then in British Pat. No. 1596602 where in the emulsions prepared the great majority of the seed crystals produced are of the bi-pyramidal habit.

Examples of published literature which describe the preparation of single pyramidal silver iodide crystals are:

E. Klein, Phot. Sci. Eng. 1:52 (1957)

H. Walliser, J. F. Reber, H. Hediger and P. Junod, J. Phot. Sci. 27:85 (1979)

R. L. Daubendiek, Paper from 1978 Int. Cong. of Phot. Sci. Rochester., pp. 140–143

The silver iodide single pyramidal crystals of these references are presented more as scientific curiosities rather than having any photographic use. However these references do describe the conditions which could be used to prepare a population of single pyramid crystals.

We have found that a population of silver halide seed crystals containing at least 90% iodide and at least 80% which are of hexagonal lattice structure with each displaying a predominantly (i.e. at least about 80%) single basal face are formed when a soluble silver salt and alkali metal or ammonium iodide are mixed in a colloid dispersing medium at a controlled pI of less than 1.5 and maintaining the temperature between 30° to 90° C. Most preferably the temperature is maintained between 35° to 70° C.

Most preferably the pI is maintained at about 1.

It is to be understood that the crystal habit need not be of a perfect geometric shape but it approximates to a pyramid such that the ratio of major to minor basal faces areas is at least 4:1. For example some of the crystals have a little growth ("lower hemispherical development") on the major basal face. Therefore the term single basal face includes such crystals.

The size of the silver iodide seed crystals prepared in step (a) depends on the quantities of silver and iodide salts added during this step as well as on the agitation rate and temperature. However a useful size range is an average mean size from 0.05 to 2 microns. The preferred average mean size is from 0.15 to 1.0 microns.

The preferred concentration of the silver and iodide solutions used in step (a) is from 1.0 to 5.0 M.

In order to set a high (e.g., $10^{-1}$ M) initial iodide ion excess concentration in the colloid dispersing medium in step (a) sufficient alkali metal iodide is added to the dispersing medium to provide a pI of about 1 before the water soluble silver salt and alkali metal or ammonium iodide are added to the dispersing medium.

Preferably in step (a) the water soluble silver salt and alkali metal or ammonium iodide are double-jetted into the dispersion medium which comprises some alkali metal iodide.

In step (b) twinned silver halide crystals are formed and the silver iodide seed crystals are progressively dissolved causing the silver iodide to be incorporated into the growing mixed silver halide crystals. Preferably the temperature of the aqueous medium is from 35° to 90° C. and most preferably from 35° to 70° C.

During step (b) the pAg should be maintained between 5 and 11 and preferably between 6 and 10.

The concentration of the solutions used in step (b) is preferably between 1.0 and 5 M.

After step (b) the mole % iodide content of the twinned silver halide crystals is preferably between 30 and 40. Step (b) is terminated when all the seed silver iodide crystals have been consumed. A high iodide emulsion with small crystals is then obtained.

Step (c) the Ostwald ripening step is an optional step and is preferably employed when the conditions used produce a substantial proportion of untwinned silver halide crystals. In this step such untwinned crystals are dissolved.

Step (d) is the optional further growth step which serves to reduce the iodide mole % in the final silver halide crystals to a useful range of 0.1 to 25%. Most preferably the mole % iodide in the final silver halide crystals is from 5 to 20%.

However if iodide is required in the shell of the crystal more iodide may be added during step (d).

The temperature, pAg and solution concentration ranges employed in step. (d) are as in step (b). It may be preferred, however, to employ a different pAg in step (d) than in step (b), for example to promote a tabular habit, or to favor the twinned octahedral habit. For example, a higher pAg promotes tabular habit.

Very often step (d) follows on directly without a break from step (b) when no step (c) is employed.

Preferably in step (b) and in step (d) the soluble silver salt and the alkali metal or ammonium halide are added to the dispersion medium by the double jetting method. Most preferably the rate of addition of these solutions is controlled to provide a monodisperse silver halide emulsion i.e. renucleation of a secondary population of untwinned crystals is avoided by the known methods.

Using the method of the present invention it has been found that a more monodisperse silver halide emulsion can be prepared than that achieved by the prior art discussed above. This is because in the methods described in British Pat. Nos. 1520976, 1570581 and 1596602 the predominant habit of the seed crystals produced in step (a) is of the bi-pyramidal type. During step (b) a twinned silver halide crystal grows epitaxially on each basal face of the seed silver iodide crystal. It has been found that usually crystals of equal size do not develop on a single seed crystal.

Thus at the end of step (b) and also at the end of step (d) the uniformity in the size of the crystals produced is less than is desired when using the method of British Patent Nos. 1520976, 1570581 and 1596602.

The iodide content of the twinned crystals is more uniform across the population of crystals than when using bi-pyramidal seed crystals in step (a). As a result, because iodide confers extended spectral sensitivity, each crystal is more uniform in sensitivity leading to higher contrast. The crystals will be more uniform in their response to chemical sensitization. The crystals will therefore develop at similar rates which leads to an improvement in granularity.

It is to be understood that steps (a) and (b) need not follow directly one after the other. For example the silver iodide colloid dispersion may be made beforehand and then stored. Further it is possible to commence step (c) before the completion of step (b). In such a case a silver halide solvent (such as ammonia, sodium thiocyanate, or a thioether) may be added with the fresh halide solution after part of the bromide and/or chloride has been added to form the twinned silver halide crystal. If fairly small silver halide crystals or ones of high iodide content are desired then step (d) may be omitted. However step (d) is of particular use in the production of monodisperse twinned silver halide emulsions as hereinafter described, and therefore a method comprising step (d) is preferred.

Preferably in step (a) pure silver iodide crystals are formed but up to 10 mole % of other halides (chloride or bromide) may be present in the silver iodide crystals without disrupting their hexagonal lattice form. Thus it is to be understood that the term silver iodide crystals includes crystals containing up to 10 mole % of other halides. It is to be understood that a small fraction of the crystals formed (i.e. up to 10% by weight or number of the crystals) in step (a) may be predominantly (i.e. up to about 10%) silver chloride or silver bromide and of the face-centered cubic lattice type without marked effect on the process according to the invention.

The process of the present invention is particularly suitable for the production of twinned silver halide emulsions of the monodisperse type. In the preferred method of achieving this the silver iodide emulsion prepared in step (a) is itself of the monodisperse type. Such emulsions may be prepared by the mixing of aqueous solutions of a silver salt and an alkali metal or ammonium iodide in a stirred solution of a protective colloid, at a fixed temperature (constant within the range of 35° to 70° C.) and pAg (constant but below 1.5). The final crystal size of the silver iodide crystals is preferably in the range 0.05–2.0 microns.

It has been found that the average size of the silver iodide crystals formed in step (a) influences the size of the twinned crystals formed in step (b). In general the larger the silver iodide crystals produced in step (a) the larger the twinned crystals formed in step (b).

One method of increasing the size of the silver iodide crystals formed (in step (a)) is to carry out step (a) in the presence of a silver iodide solvent, such as ammonia, or pyridine.

The solubility of the silver iodide may conveniently be controlled by variation of temperature, the quantity of excess iodide and the proportion of silver iodide solvent in the dispersing medium.

It is also evident that the crystal size distribution of the final twinned emulsion depends also on the crystal size distribution of the silver iodide formed in step (a). The wider the size distribution of the seed crystals, the wider the size distribution of the final twinned emulsion.

Thus although it is preferred for high-contrast applications such as X-ray films that the silver iodide crystals in step (a) be monodisperse, for low-contrast applications such as monochrome camera films, it may be preferred for some purposes to prepare a relatively polydisperse twinned silver halide emulsion by producing a relatively wide size distribution, e.g. a distribution with coefficient of variation greater than 30% of the silver iodide crystals prepared in step (a). Alternatively such a wide size distribution may be produced by blending of monodisperse, silver iodide emulsions of different size before the commencement of step (b). Thus the control of size and size distribution of the twinned silver halide crystals produced in steps (b), (c) and (d) can be achieved by selection of the size and size distribution of the silver iodide crystals formed in step (a).

Preferably, the recrystallization step (b) in which the twinned crystals are nucleated is effected by the addition of aqueous solutions of silver nitrate and sodium bromide or chloride or mixtures thereof to a stirred dispersion single pyramidal (or single basal face) of silver iodide in gelatin solution, at a fixed temperature and pAg. Other alkali metal or ammonium salts of bromide or chloride may be used.

Preferably no additional iodide is added in the halide solution, but the possibility of adding small amounts is not excluded (i.e. up to about 10 mole % of the halide added in this step may be iodide). The silver and halide solutions may be any concentration up to the solubility limit at the particular temperature used. The preferred range lies within the limits about 1.0 to about 5 M, most preferably from about 1.0 to about 2 M.

The solutions may be stored at room temperature immediately prior to addition to the precipitation vessel, or kept at an elevated temperature, preferably in the range 30°–70° C. It is most advantageous to maintain the flow rate of the silver nitrate solution constant during this stage with the necessary adjustments being made to the addition rate of the halide solution. However, as previously stated, if step (c) (in which silver halide solvent is added) is omitted, the rate of addition of aqueous solution in step (b) must be so controlled that by the end of this step the silver halide crystals formed are predominantly (i.e. more than about 80% of the crystal population) twinned. These conditions are set forth below.

It is preferred in the present invention that in order to prepare a crystal population of the highest uniformity in step (b) which may be used to prepare monodisperse emulsions, the addition rates of the silver and halide solutions added in step (b) should be predetermined by routine experimentation. The optimum flow rates in this respect depend on the nature of the halide, and increase with the number of silver iodide crystals in the aqueous dispersion medium decreasing crystal diameter of silver iodide crystals, the pAg in the range specified above, and the temperature. For example higher rates of addition are required in the preparation of silver iodochloride or silver iodochlorobromide emulsions than in their silver iodobromide equivalents, the latter being illustrated in Examples 1 and 2.

It is preferred in the recrystallization step (b) that the volumes of silver nitrate and alkali metal or ammonium halides added should be such that the silver iodide comprises from 30–40 mole % of the total silver halide at the end of this step. As an indication of the appropriate flow rate the rate should be adjusted until the dissolution of the silver iodide is substantially complete by the time at which a quantity of silver nitrate one to three times the equivalent to the silver iodide has been added. One means of following the dissolution of silver iodide in step (b) and hence deducing the optimum flow rate is X-ray diffraction. As the AgI produced has an hexagonal lattice, and silver iodobromide (with <40 mole % Ag I) a cubic lattice, quite different diffraction patterns are displayed by the two phases. Using copper $K_{alpha1}$ radiation, a scan between 70° and 74.5° in scattering angle covers the (300) and (213) reflections of beta-AgI, the (422) reflection from any gamma-AgI present, and the (420) reflection or reflections from phases of cubic silver iodobromide.

The changes in relative intensity of these reflections through the recrystallization step (b) can be followed and it can be seen that the prominent (213) reflection from beta-AgI disappears when the average iodide content of the emulsion drops to 30 mole %. Another means of judging when the dissolution of silver iodide is substantially complete is by taking electron micrographs at different times during the recrystallization, as the distinctive crystal habit of the silver iodide crystals allows them to be differentiated from silver halide crystals of the usual face-centered cubic lattice.

Stages (a), (b) and (d) may be divided into sub-stages, and the emulsion stored, for convenience of manufacture after each stage. Also, electron micrographs of emulsion samples extracted during experimental preparations in which the addition rate during step (b) is varied can be used to give another indication of the optimal flow rates. If an Ostwald ripening stage, step (c) of the present invention, is to be included it is preferable to employ a constant flow rate in step (b) and electron micrographs of the final, ripened emulsion at the end of step (c) can be used to select the optimal rate of addition during step (b) which would produce a population of twinned crystals of greatest uniformity and shape. The optimal flow rate during step (b) which is most appropriate for the conditions chosen for the ripening step (c) can thus be determined by prior routine experiment. It is a particular feature of the present invention that if the Ostwald ripening stage, step (c), is omitted, that in step (b) the addition rate of the reagent solutions should be so controlled that the silver halide crystals formed in this step are predominantly of the twinned type and that no substantial formation of new untwinned crystals takes place following the methods just set forth.

Preferably the addition rates should be so chosen also that no Ostwald ripening among the existing population of twinned crystals should occur. The experimental predeterminations necessary to ensure that the optimal range of flow rates may be employed are described in British Patent Specification No. 1469480.

An excessively low addition rate in step (b) would lead to incomplete recrystallization of the silver iodide crystals formed in step (a) and excessive widening of the size distribution of the twinned crystals which are formed, due to Ostwald ripening or due to uneven nucleation across the surface of the seed crystal. An excessively high addition rate in step (b) would lead to a substantial renucleation of untwinned crystals which could be readily detected due to their characteristic regular cubic or octahedral shape. In this case, only part of the final crystals will have been formed under the direct influence of the silver iodide, leading to a wide distribution of iodide content, and the size distribution of the final emulsion will invariably be bimodal. Both effects would lead to a loss of photographic contrast in the final emulsion. In addition the emulsion would be difficult to sensitize efficiently. A population of twinned crystals more uniform in size and shape results from the selection of an appropriate intermediate rate of addition during step (b), and this is illustrated in one of examples given hereafter.

During step (b) the silver iodide seed crystals gradually dissolve and the iodide is incorporated in the growing twinned crystals. Various factors have already been described which can influence the extent of the recrystallization i.e. whether in fact it is completed. These factors also influence the composition of the cubic silver halide phase in the twinned crystals. In particular, temperature, pAg and solution addition rates have a strong influence. At one extreme when high temperatures (from about 65° to about 70° C.) high pAg (from about 8.5 to about 9.5) and low addition rates, for example 0.01 moles silver nitrate per minute per mole of silver iodide seed are employed, thermodynamic equilibrium is approached and the proportion of iodide in the twinned crystals is close to the saturation limit, e.g. 39 mole % at 70° C. Under other conditions the process is kinetically controlled and a lower proportion of iodide is incorporated in the solid solution phase of the twinned crystals prepared in step (b).

In order that ripening occurs at a conveniently fast rate during step (c) it is necessary to add silver halide solvents such as an excess of halide salts or ammonia, or other silver halide complexing agents such as sodium thiocyanate. The relative concentration of solvents may affect the crystal habit observed after ripening. The effect of excess bromide and ammonia in Ostwald ripening on the habit of silver iodobromide crystals is described by Marcocki and Zaleski (Phot Sci Eng 17, 289 (1973)); the effect of a slight (e.g. 0.1 M) excess of bromide is to favor the formation of the octahedral habit.

The Ostwald ripening in step (c) of the present invention is most preferably carried out in conditions favoring octahedral habit. The preferred silver halide solvent is ammonia, added to a final concentration in the range 0.1–1.5 M, and the preferred temperature for the ripening is between 50°–70° C. The preferred pAg value for the ripeninq stage is in the range 7–10. Excessively high temperatures (generally over about 70° C.) or halide or ammonia concentration (over about 0.5 M) usually result in a widening of the final size distribution.

In order to increase the rate of addition of the aqueous solutions in step (b), whilst still ensuring that the crystals obtained at the end of step (b) are predominantly of the twinned type, it is advantageous to employ small proportions of alkali metal halides in steps (a) and (b) which have cation radii which are appreciably different from the commonly used sodium, potassium or ammonium salts. Thus the optimal rate of addition employed during step (b) can be raised by employing a small proportion (e.g. about 0.1 to about 1.0 mole percent based on the iodide salt) of an alkali metal halide with a cation radius smaller than that of silver, such as lithium, during the preparation of the silver iodide crystals in step (a), or by employing a small proportion (e.g. about 0.1 to about 1.0 mole percent based on the iodide salt) of an alkali metal halide with a cation radius larger than that of silver, such as rubidium, during the recrystallization step (b). A table of cation sizes is given by R. A. Robinson and R. H. Stokes in "Electrolyte Solutions" page 461, 2nd ed, Butterworths (1959). It is believed that small amounts of these ions become occluded in the respective silver halide lattices during precipitation, and increase the rate of conversion of the hexagonal lattice type crystals formed in step (a). Other possible methods of increasing the rate of epitaxial growth (or dissolution rate of the silver iodide crystals) during step (b) are to carry out step (b) in the presence of a wetting agent such as a polyalkene oxide condensate (such as p-isooctylphenoxy polyethylene oxide) or a silver iodide solvent (such as ammonia, or pyridine). It is believed that polyalkene oxides can accelerate the conversion of silver iodide to silver iodobromide or iodochloride by complexing iodide ions or displacing gelatin from the surface of crystals undergoing recrystallization, whereas incorporation of a proportion of a silver iodide solvent in the dispersion medium during step (b) can affect the rate of conversion by a direct influence on the solubility.

A high concentration of ammonia encourages the formation of the cubic habit in silver iodobromide crystals, and for this reason it is preferred that the recrystallization step (b) for silver iodobromide emulsions should be carried out in a low concentration of ammonia (e.g. $<0.5$ M per mole of silver). Conversely for silver iodochloride or silver chloride crystals, a high concentration of ammonia encourages the formation of the octahedral habit (Berg et al. Die Grundlagen der Photographischen Prozesse mit Silberhalogeniden Band 2 p 640) and therefore in the preparation of twinned silver iodochloride emulsions according to the first mode the recrystallization step (b) and ripening step (c) should be carried out at an ammonia concentration within the preferred range of 0.5–1 M throughout. This is conveniently achieved by the addition of a concentrated ammonia solution to the alkali metal or ammonium chloride solution. However twinned cubic silver iodochloride emulsions may be prepared without the addition of ammonia at a pAg range of about 6.0 to about 8.0.

Similarly within the scope of the present invention twinned silver halide photographic emulsions of the intermediate tetradecahedral habit may be produced by selection of the appropriate solution conditions, such as using a pAg of from about 6.0 to about 8.0 in the presence of 0.2 M ammonia.

The process of the present invention is particularly suitable for the production of twinned silver halide emulsions of the monodisperse type. In this aspect of the invention step (d) is included and during this step further silver and halide solutions are added by a double-jetting method and at a controlled pAg (between about 6 and about 10). Preferably the additional halide added during this stage is such that the iodide content of the final crystals is about 5–15 mole % which is the amount of iodide which has been found to be most beneficial, yielding high-speed emulsions for negative working photographic material.

The halide solution added in step (d) can be any combination of alkali or ammonium salts of chloride, bromide or iodide. It is preferred that the iodide content is restricted to no more than 15%, most preferably no more than 10%. The proportion of iodide in the halide stream can be varied with time: it can be decreased at a constant rate to produce smoothly decreasing iodide levels towards the surface of the final emulsion crystals, or it can be changed by abrupt increments introduced under such conditions as to create a distinct interface between two phases of different iodide content. An example of an abrupt change is a change of the concentration of the halide stream from about 10 mole % iodide to about 5 mole % iodide. The introduction of this internal iodide, i.e. in addition to that derived from the silver iodide seed emulsion, can be used to favor partial development of individual crystals, with a consequent improvement in image quality, see K. Radcliffe, J. Phot. Sci. 24:198, 1976.

In step (d) in the process of the present invention it is preferred to maintain the pAg in the range 5.0 to 11.0 and most preferably in the range 6.0 to 10.0. The temperature may be set within a wide range, for example 35° to 90° C. It is a particular advantage of this invention that these values may be varied during step (d). For instance by controlling the temperature, pAg and reagent solution addition rates during the initial stages of this step, dissolution of the emulsion crystals produced in steps (b) or (c) can be largely prevented. If the crystals dissolve these variables should be adjusted in the following order: increasing the addition rate, decreasing pAg, increasing the temperature. Further twinned emulsions of high sensitivity can be produced by forming twinned crystals of high iodide content in step (b) of this invention, then adding silver nitrate and sodium bromide to this in step (d) producing a core/shell emulsion, where the iodide is concentrated in the center of the emulsion grains.

The pAg can be varied during step (d) of this invention to modify the habit of the final twinned emulsion crystals. By selection of fixed pAgs in the range 6 to 9, (100) external faces are favored leading to cubic crystals. It is a particular feature of this invention that crystals displaying the cubic habit can be prepared with a narrow size distribution whilst containing high levels of iodide.

Preferably step (e) is included and in this step the emulsion is desalinated and surface sensitized.

The water soluble salts formed during the preparation of the silver halide crystals may be removed as they are formed, that is to say after step (a), after step (b) and well as after step (d).

The water soluble salts formed or the ripening agents added during the process of the present invention may be removed by any of the well-known methods. Such methods often involve flocculating the silver halide and colloid dispersing agent, removing this flocculate from the then aqueous medium washing it and redispersing it in water. One other common method is ultrafiltration, in which the emulsion is passed over a membrane under pressure.

The pore size of the membrane is such that the silver halide crystals and most of the colloid dispersing medium, is retained, whilst water and solutes penetrate through. Most of the well-known methods allow the emulsion to be concentrated as well as washed. This is important when weak reagent solutions are employed, particularly those with concentrations below 3 M.

As already mentioned, core/shell emulsions may result from the process of this invention. Further advantages may result from washing and concentrating the emulsion at other stages in the process of this invention. It is specifically contemplated that water soluble salts are removed throughout the process of this invention by, for instance, recirculating emulsion for the precipitation vessel through an ultrafiltration membrane.

Blending of emulsion components may take place at any stage in the preparation of the final emulsion according to the process of this invention. This may be done to adjust contrast and exposure latitude, as has already been mentioned. In the preferred method the components are blended after step (e), this is after the components have been optimally chemically sensitized or after spectral sensitization has taken place.

The silver halide crystals may be chemically sensitized at any stage of growth by any of the well known means, for example by use of sulphur or selenium compounds or salts of the noble metals such as gold, iridium, rhodium, osmium, palladium or platinum. Examples are sodium tetrachloroaurate dihydrate, sodium thiosulphate, sodium chloropalladate and gold thiocyanate. Chemical sensitization is optimally carried out in the presence of sulphur-containing ripening agents such as thioethers or thiocyanate compounds, e.g. sodium thiocyanate. Often the fully grown crystals may be sensitized in this manner so that the products of chemical sensitization are formed on or close to the surface of the crystals, so that such sensitized crystals would become developable in a surface developer after exposure to light. This can be accomplished, for example, by heating the emulsion to 50° C. or above in the presence of at least one sensitizing agent.

Emulsions comprising such sensitized crystals would be suitable for negative film materials. However it is sometimes required for direct positive materials, that the products of chemical sensitization are produced in the interior of the crystal. A number of such products of chemical sensitization may be incorporated into the body of the crystals by heating the crystals at the required stage of growth (e.g. when half the crystal volume has been deposited) with appropriate sensitizing compounds. These can include salts of non metals, such as sulphur or selenium or metals such as gold, platinum, palladium, iridium, rhodium, thallium, osmium, copper, lead, cadmium, bismuth and the like. It is also possible to effect internal reduction sensitization by treating the crystals with reducing agents for example thiourea dioxide, hydrazine, formaldehyde or stannous chloride.

These compounds can either be added continuously during a part of the whole of the crystallization process, for example by incorporating them into the feedstock solutions; or alternatively the crystallization process can be halted, the part-grown crystals treated with the appropriate reagent, and growth recommenced.

Such internally modified crystals can be used in a variety of processes. For example, a direct-positive emulsion can be prepared using the following broadly-defined stages: (i) treating the crystal at an intermediate stage of growth in such a way as to produce centers which promote the deposition of photolytic silver (treatment with iridium or rhodium salts being particularly preferred), (ii) completion of the growth process, (iii) fogging of the crystal surface either by exposure to actinic radiation or by chemical reduction (in the preferred process the crystal is fogged by a combination of a reducing agent and a compound of a metal more electropositive than silver, such as gold or palladium). Such an emulsion, after coating, imagewise exposure, and development with a surface developer will yield a direct positive image. The usual additives can be applied to the direct positive emulsion if required e.g. soluble halides to increase speed, sensitizing or desensitizing dyes to increase spectral range, electron trapping agents, blue speed increasing compounds and the like.

Internally modified crystals may also be prepared to provide emulsions with ah enhanced ratio of internal to surface speed. Whilst a number of the previously-mentioned methods can be used, the preferred technique is to (i) precipitate a core emulsion, (ii) sensitize the surface of the core crystals using a sulphur compound and/or a gold compound as in the known art, and then (iii) grow a shell of silver halide onto the core emulsion by one of known techniques such as Ostwald ripening in the presence of suitable ripening agents, double-jet growth, or pAg cycling through the neutral point.

For certain purposes, other techniques can produce emulsions whose internal/surface sensitivity relationship is comparable with that obtained from internal gold/sulphur sensitization, for example doping with heavy metal ions (gold, iridium, rhodium, palladium, or lead) or by halide conversion or halide layering techniques.

The speed of such internally sensitized emulsions may be increased by adding one or more or reagents commonly used with negative emulsions, such as sodium thiocyanate. In particular, it is possible to spectrally sensitize these emulsions with dyes of the type commonly used with surface-sensitive negative emulsions, e.g. a cyanine dye). It is advantageous in this case to use high surface coverage of dye, such as would cause desensitization in a surface-sensitized emulsion of the same size, since the internal image is not subject to dye-induced desensitization. Thus, amounts of dye ranging between about 0.4 and about 1.0 g per mole of silver halide are preferred.

Internally sensitive emulsions can be developed using one of the techniques known in the art. These mainly involve a developer of standard type, for example, a metol and/or hydroquinone containing developing solution with the addition of quantities of either free iodide, or a silver halide solvent such as an alkali thiosulphate. Optionally, the surface can be bleached with an oxidizing agent before development, to remove surface image (Sutherns, J. Phot. Sci. 9:217 (1961)).

If the shell silver halide layer is thin (of the order 15 lattice planes) it is possible to develop the crystal in a surface developer, such as a metol and/or ascorbate developing solution. Such a technique produces an emulsion yielding a conventional surface image but again avoids the desensitization resulting from large dye additions to surface-sensitive emulsions.

By using a surface developer containing certain fogging (or nucleating) agents, such as certain substituted hydrazine compounds or certain quaternary ammonium salts, it is possible to produce a direct-positive image with the internally-sensitive emulsions described above. A nonlimiting example of a suitable hydrazine compound is sodium phenyl hydrazine and one of an ammonium salt is cetyl pyridinium bromide. It may also be advantageous in this case to introduce a small degree, of surface sensitivity into the crystals. Internally-sensitive emulsions may be produced by interrupting the crystal growth at any stage during the steps (a)-(d) according to the present invention, and then adding such chemical sensitizing agents as those mentioned above. After such a chemical sensitization, crystal growth is resumed so that the sensitivity centers become "buried" inside each crystal. Such techniques are well known and are described for example in British Patent Specification 1027146.

The process of the present invention can be used to prepare direct positive emulsions, using otherwise conventional technology as described, for example, in BP 723,019 and in the paper by Vanassche et al. Journal Phot Sci 22, 121 (1974). The silver halide emulsion as prepared by the process of the present invention is fogged using a combination of a reducing agent (thiourea dioxide, hydrazine, tin salts and several others are known) and a compound of a metal more electropositive than silver (gold and/or palladium are preferred). An electron-trapping compound, preferably one which is also a spectral sensitizer for the direct positive process (such as phenosafranine), is added and the emulsion is coated. After exposure and development a surface image is revealed. It is also possible to incorporate into such emulsions one or more of the additives normally used with fogged direct positive emulsions, for example soluble halides, sensitizing dyes and blue-speed increasing compounds. It is also possible to protect the surface fog from atmospheric oxidation by covering it with a thin silver halide layer, so that it is still accessible to conventional surface developers. In direct positive systems of this type cubic crystals are generally preferred, because they give better speed/and contrast.

It is to be understood that the twinned crystals formed at the end of step (b) are often very small crystals which are only of use as seed crystals. These crystals may be grown to usable size during step (d). However, as hereinbefore stated it is possible to have a prolonged step (b) so that at the end of step (b) usable crystals are produced.

Nevertheless in the process of this invention step (b) may merge into step (d) without any interruption in the addition of the aqueous solutions occurring in the second mode.

However in general the twinned crystals formed at the end of step (b) can themselves be used as seed crystals, thus the silver iodide dissolved from the silver iodide crystals formed in step (a) will be present in the seed crystal and thus after the growth step (d) will be present in the core of the crystal unless further iodide is added during step (d). Similarly if noble metals are present in step (a) these will be included in the twinned seed crystals formed in step (b) but after the growth step (d) will be present in the final crystals as part of the core.

In order to alter the properties of the final silver halide crystals it is possible to alter the halides added during step (b) or to change completely the halides or halide proportions employed from step (b) to step (d). Thus it is possible to obtain layers of a particular halide proportion in the final crystals by arranging for a particular halide proportion in the final crystals to be used at any stage in step (b) or in step (d) in the process of the present invention.

Where the emulsions prepared by the process of the present invention are to be used for negative working photographic material it is advantageous that after the recrystallization step (b) or ripening step (c) (if included) the halides in step (d) are added so that up to 15 mole % iodide is precipitated in a "shell" surrounding the "core" twinned crystals formed in step (b) and that up to 10 mole % chloride is precipitated in the outermost shell of the crystals when chloride is added as part of the halide stream in step (d).

Thus silver iodochorobromide emulsions can be prepared according to the present invention with crystals containing "internal" iodide (in addition to that derived from the original silver iodide crystals) and "surface" chloride layers.

Where the emulsions prepared by the process of the present invention are to be used for direct positive materials or other applications where internally sensitive crystals are desired, it is advantageous that the halide precipitated during the first part of the growth step (d) should be predominantly bromide. Thus silver iodochlorobromide emulsions can be prepared according to the present invention with crystals containing "internal" chloride and "surface" bromide layers.

Such "core-shell" emulsions are well known and are also described in British Patent Specification 1027146.

The emulsions prepared by the process of the present invention may be spectrally sensitized by the addition of spectral sensitizers for example carbocyanine and merocyanine dyes to the emulsion in step (e), see Theory of the Photographic Process, by James, 4th Ed., published by McMillan and in particular Chapter 8.

The emulsions may contain any of the additives commonly used in photographic emulsions for example wetting agents, such as polyalkene oxides, stabilizing agents, such as tetraazaindenes, metal sequestering agents, such as ethylene diamene tetraacetate, growth or crystal habit modifying agents commonly used for silver halide such as adenine, and plasticizers such as glycerol to reduce the effect of mechanical stress.

Preferably the dispersing medium is gelatin or a mixture or gelatin and a water-soluble latex for example or latex vinyl acrylate-containing polymer. Most preferably if such a latex is present in the final emulsion it is added after all crystal growth has occurred. However other water-soluble colloids for example casein, polyvinyl pyrrolidone or polyvinyl alcohol or hydrophilic cellulose esters and ethers may be used alone or together with gelatin.

The silver halide emulsions prepared according to the process of the present invention may exhibit an improvement in speed/granularity, particularly in the minus blue region of the spectrum and increased sharpness.

The silver halide emulsions prepared according to the present invention thus are of use in many types of photographic materials such as X-ray films, camera films: both black and white and color, paper products and their use could be extended to other materials for example direct positive materials.

Thus the invention includes silver halide emulsions prepared by the process of the present invention and coated photographic silver halide material containing at least one such emulsion.

EXAMPLES

The following examples will serve to illustrate the invention without limiting its scope.

EXAMPLE 1

Preparation of a Tabular Twinned Octahedral Silver Iodobromide Emulsion According to This Invention.

Emulsion B

Preparation of a pyramidal monosized silver iodide emulsion step (a).

2600 g of 9.6% w/w aqueous solution of inert gelatin was stirred at 40° C. at 400 rpm in a stainless steel vessel. Tri-n-butyl orthophosphate was added as an antifoam. Approximately 53 $cm^3$ of a 4.7 M aqueous solution of potassium iodide was added to give pI=1. Aqueous 4.7 M solutions of silver nitrate and potassium iodide were jetted into the stirred gelatin at a rate (for the silver nitrate solution) increasing from approximately 20 $cm^3$/min to 33 $cm^3$/min until a total of 1600 $cm^3$ of silver nitrate solution had been added over a period of approximately 65 minutes.

Then, further volumes of these solutions were added at a rate (for the silver nitrate solution) increasing from 50 $cm^3$/min to 90 $cm^3$/min until a total of 10840 $cm^3$ of silver nitrate solution had been added over a period of 162 minutes. The pI of the emulsion was maintained throughout at a value of 1 (+0.05) by adjusting the rate of flow of the potassium iodide solution. The temperature was kept at 40° C.

The yield was approximately 58.5 moles of silver iodide. 3420 g of a 27% w/w aqueous solution of inert gelatin was added to the silver iodide emulsion. The crystals of this emulsion are shown in FIG. 1. They had a mean crystal diameter of 0.32 microns (based on a measurement of projected area). This emulsion was then desalinated.

These crystals were 100% iodide and approximately 95% had a single pyramid habit.

Recrystallization (step b).

Approximately 4235 g of the silver iodide emulsion grown in step a which contained 6 moles of silver iodide was stirred at 65° C. at 400 rpm in a stainless steel vessel. Tri-n-butyl orthophosphate was added as an antifoam. Aqueous solutions of 1.5 M silver nitrate and 1.5 M sodium bromide were jetted into the stirred silver iodide emulsion at rates (for the silver nitrate) increasing from 0.012 mole/min to 0.024 mole/min until 0.6 mole of silver nitrate had been added over a period of 38 minutes. 720 g of 25% w/w aqueous of inert gelatin was added, and further volumes of silver nitrate and sodium bromide solutions were jetted in at a rate (for the silver nitrate) of 0.036 mole/min until 8.4 mols of silver nitrate had been added.

403 g of the above gelatin was added, and further volumes of the silver nitrate and sodium bromide solutions were jetted in at a rate (for silver nitrate) of 0.072 mole/min until 5.0 mols of silver nitrate had been added.

The pAg of the emulsion was maintained throughout at 7.65 (±0.1) by adjusting the flow rates of the bromide solution and the temperature was maintained at 65° C. The emulsion had a mean crystal size of 0.6 microns (based on a measurement of volume). The yield was 20 moles of silver halide with an overall content of 30% silver iodide.

Further growth (step d).

Approximately 3576 g of the above mixed silver iodobromide emulsion which contained 2.78 moles of silver halide was stirred at 65° C. at 400 rpm in a stainless steel vessel. Tri-n-butyl orthophosphate was added as an antifoam. 148 g of 25% w/w aqueous inert gelatin was added. Aqueous solutions of 1.5 M silver nitrate and 1.5 M sodium bromide were jetted into the stirred silver iodobromide emulsion at rates (for the silver nitrate) increasing from 0.015 mole/min to 0.03 mole/min until a total of 1.85 mole of silver nitrate had been added over a period of 86 minutes.

296 g of the above gelatin was added and further volumes of the silver nitrate and sodium bromide solutions were jetted in at rates (for the silver nitrate solution) increasing from 0.06 mole/min to 0.09 mole/min until 3.69 mole of silver nitrate had been added over a period of 53 minutes.

The pAg of the emulsion was maintained throughout 9.16 (±0.1) by adjusting the flow rates of the bromide solution and the temperature was maintained at 65° C.

Figure 2:
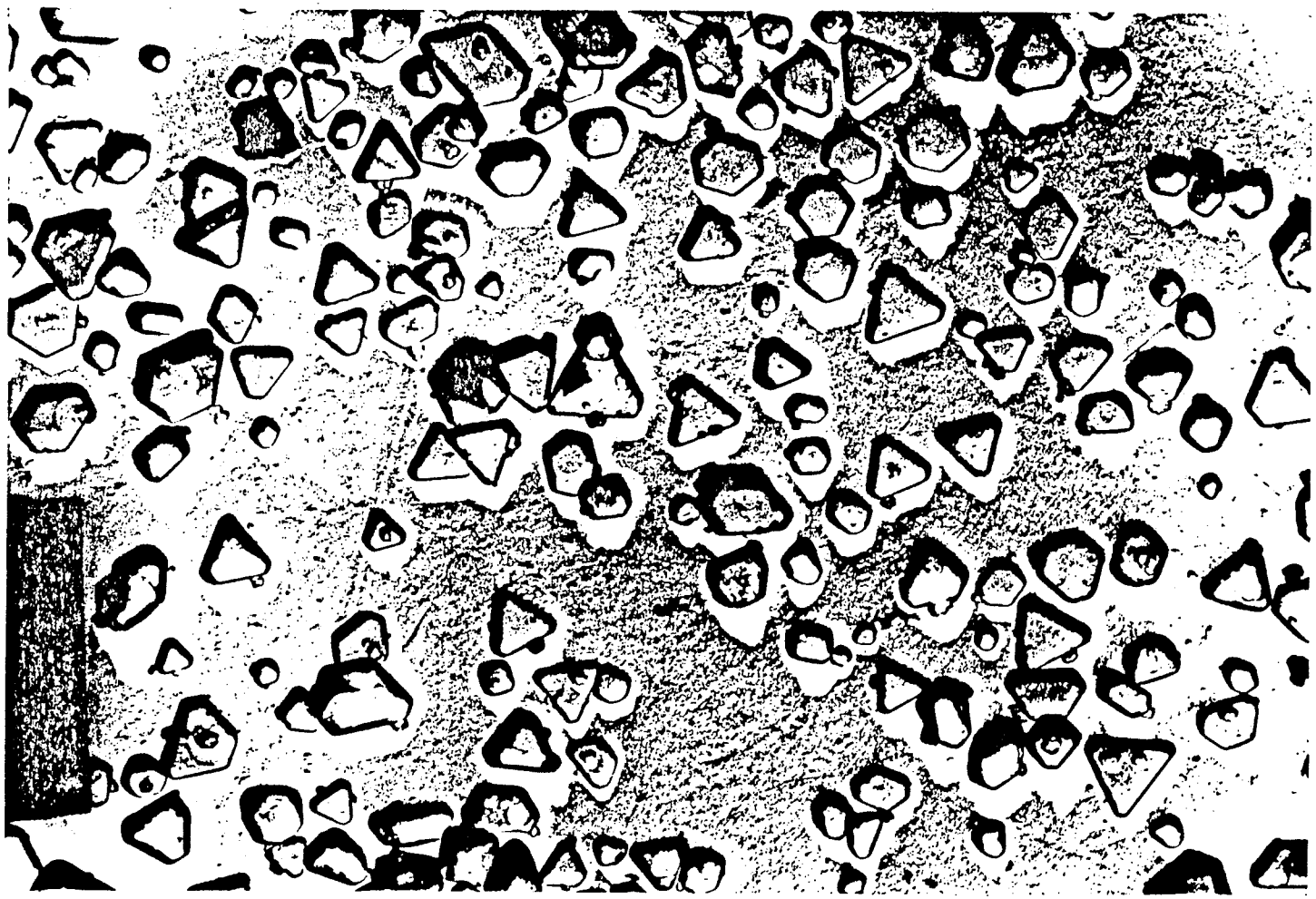
FIG. 2 is an electron micrograph of mixed silver halide crystals prepared in accordance with the procedure of Example 1 through step (d).

The crystals of the final emulsion are shown in FIG. 2. They had a mean diameter of 0.75 microns (based on a measurement of volume). The overall proportion of silver iodide was 10% of the total silver halide and the yield was 8.32 moles of silver halide.

Sensitization (step e).

The emulsion was desalinated and redispersed with a solution of limed ossein gelatin. It was adjusted at 40° C. to pH 6.0 and pAg 8.2. It was then digested at 52° C. for a range of times and with a range of sensitizer quantities. Optimum photographic sensitivity was found when 13.33 mg sodium thiosulphate pentahydrate and 2.67 mg sodium tetrachloroaurate dihydrate per mole of silver halide was added. The emulsion was stabilized using 0.41 g of 4-hydroxy-6-methyl-1,3,3a tetraazaindene per mole of silver halide. The optimally sensitized emulsion was then coated on a triacetate base at 45 mg Ag/$dm^2$.

COMPARATIVE EXAMPLE

Preparation of Tabular Twinned Octahedral Silver Iodobromide Emulsion

Emulsion A

Emulsion (A) was produced following the method described in BP 1596602 (Example 1) and was similar in final crystal size, iodide mole % and recrystallization conditions to Emulsion B as just prepared.

Preparation of bi-pyramidal monosized silver iodide emulsion (step a).

2750 g of 9.0% w/w aqueous solution of inert gelatin was stirred at 40° C. at 1000 rpm in a stainless steel vessel. Tri-n-butyl orthophosphate was added as an antifoam. Sufficient of a 4.7 M aqueous solution of potassium iodide was added to give pI 2.3.

Aqueous 4.7 M solutions of silver nitrate and potassium iodide were jetted into the stirred gelatin at a rate (for the silver nitrate solution) increasing from approximately 20 $cm^3$/min to 65 $cm^3$/min until a total of 1600 $cm^3$ of silver nitrate solution had been added over a period of approximately 41 minutes.

Then, further volumes of these solutions were added at a rate (for the silver nitrate solution) increasing from 100 $cm^3$/min to 175 $cm^3$/min until a total of 10840 $cm^3$ of silver nitrate solution had been added. The pI of the emulsion was maintained throughout at a value of 2.3 (±0.05) by adjusting the rate of flow of the potassium iodide solution. The temperature was kept at 40° C.

The 13065 ml of 4.7 M of silver nitrate and 4.7 M potassium iodide were added at 390 ml/minute maintain the pI at 2.3±0.1. During this period 4875 g of 32% w/w inert aqueous gelatin was also added.

Finally 26130 ml of 4.7 M silver nitrate and 4.7 M potassium bromide was added maintaining the pI at 2.3±0.1. The rate of addition was increased from 488 to 585 ml/min.

During this period 6611 g of 32% w/w inert aqueous gelatin was added.

Figure 3:
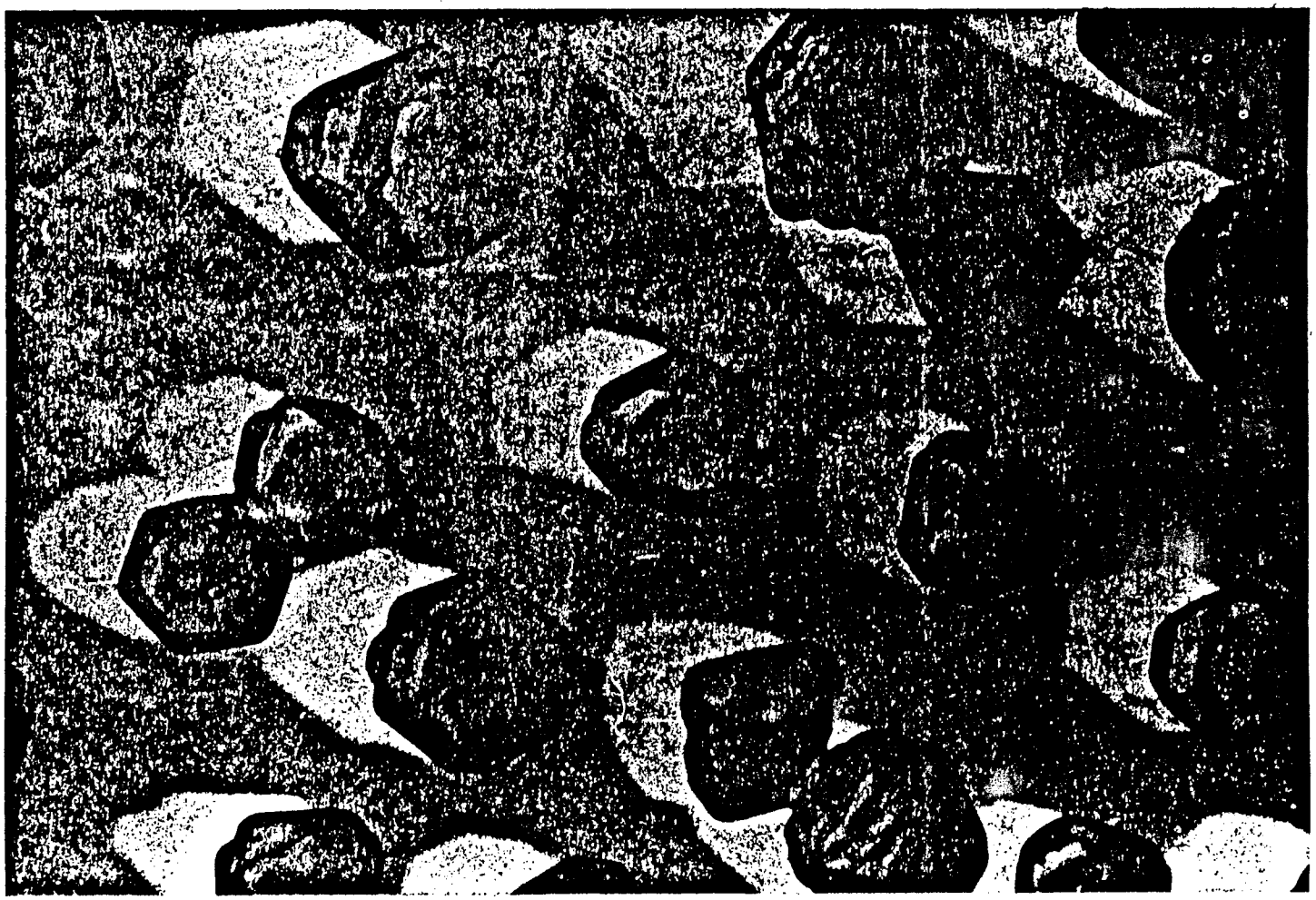
FIG. 3 is an electron micrograph of silver iodide crystals produced by step (a) of the Comparative Example.

The yield of emulsion obtained after all these additions was 243 moles of silver. The median diameter of the silver iodide crystals was 0.61 microns (based on volume) and over 95% were of the truncated bi-pyramidal habit. They were 100% silver iodide. These seeds are shown in FIG. 3.

Recrystallization (step b).

Approximately 6120 g of the above silver iodide emulsion which contained 24 moles of silver iodide was stirred at 65° C. at 100 rpm in a stainless steel vessel. Tri-n-butyl orthophosphate was added as an antifoam.

Aqueous solutions of 4.7 M silver nitrate and 4.7 M sodium bromide were jetted into the stirred silver iodide emulsion at rates (for the silver nitrate solution) increasing from 0.024 mole/min to 0.048 mole/min until 2.4 mole of silver nitrate had been added over a period of 75 minutes. 1488 g of 35% w/w aqueous inert gelatin was added, and further volumes of the silver nitrate and sodium bromide solutions were jetted in at a starting rate of 0.153 mole/min (for the silver nitrate) until 26.80 moles of silver nitrate had been added. 1552 g of 38% aqueous inert gelatin was added.

Further volumes of the silver nitrate and sodium bromide solutions were jetted in at a starting rate (for the silver nitrate) of 0.235 mole/min until 26.80 mols of silver nitrate had been added.

The pAg of the emulsion was maintained throughout at 7.65 (±0.1) by adjusting the flow rate of the bromide solution and the temperature was maintained at 65° C. The yield was 80 moles of silver halide with an overall content of 30% silver iodide. The average diameter of the silver iodobromide crystals was 0.8 microns.

Further growth (step d).

Approximately 14400 g of the above mixed silver iodobromide emulsion which contained 20 moles of silver halide was stirred at 65° C. at 1000 rpm in a stainless steel vessel. Tri-n-butyl orthophosphate was added as an antifoam. Aqueous solutions of silver nitrate and sodium bromide were jetted into the stirred silver iodobromide emulsion at rates (for the silver nitrate) increasing from 0.0973 mole/min until a total of 13.33 mole of silver nitrate had been added over a period of 83 minutes at a pAg of 9.2. 747 g of 36% aqueous inert gelatin was added.

Further volumes of the silver nitrate and sodium bromide solutions were jetted in at rates for the silver nitrate increasing from 0.686 mole/min until 26.67 moles of silver nitrate had been added over a period of 61 minutes. The pAg of the emulsion was maintained throughout at 9.2 (±0.1) by adjusting bromide solution and the temperature was maintained at 65° C.

Figure 4:
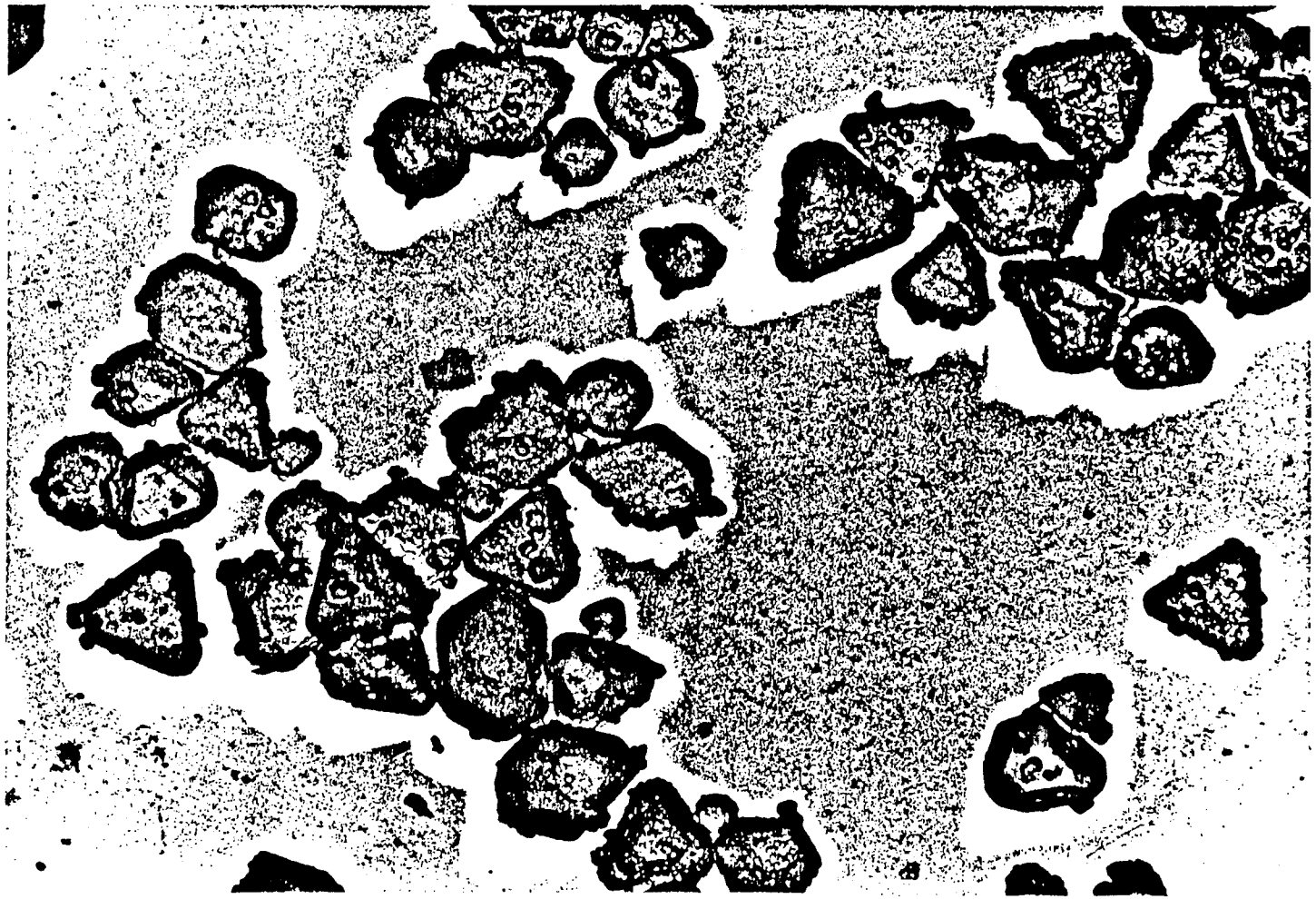
FIG. 4 is an electron micrograph of silver halide crystals prepared in accordance with the procedure of the Comparative Example through step (d).

The crystals of the final emulsion are shown in FIG. 4. They had a mean size of 0.9 microns (based on a measurement of volume). The overall proportion of silver iodide was 10% of the total silver halide and the yield was 60.0 moles of silver halide.

This emulsion was chemically sensitized as the emulsion B except that optimum photographic sensitivity was found when 8.88 mg of sodium thiosulphate pentahydrate and 1.33 mg of sodium tetrachloroaurate per mole of silver halide was added.

The optimally sensitized emulsion was then coated on a triacetate base at 50 mg Ag/$dm^2$.

This emulsion is referred to as Emulsion A.

Coated samples of emulsion A and B were photographically exposed through a continuous wedge to white light for 0.02 seconds and developed for 8 minutes in a developer of the following formula (developer I) at 20° C.

| | |
|---|---|
| Metol | 2 g |
| Hydroquinone | 5 g |
| Sodium Sulphite | 100 g |
| Borax* | 3 g |
| Sodium tripolyphosphate | 3.5 g |
| Water to | 1 liter |

(*sodium tetraborate 10 $H_2O$)

The results were as follows:

| Emulsion | Silver Coating Weight (mg/$dm^2$) | Median Crystal Volume (microns$^3$) | Speed | Contrast | Granularity |
|---|---|---|---|---|---|
| Emulsion A (Comparative example) | 50 | 0.38 | 4.99 | 0.53 | 39 |
| Example B (emulsion of this invention) | 45 | 0.20 | 5.03 | 0.63 | 28 |

Here, speed is photographic foot speed on a relative log exposure scale at a density of 0.1 above fog. Contrast is the mean slope of the graph of density against log exposure, over a range of 1.5 log exposure units from a density of 0.1 above fog.

Granularity is the root mean square granularity at a density of 1.0 above fog.

The above photographic results show the emulsion of this invention (emulsion B) to have higher sensitivity than that prepared according to BP 1596602 (emulsion A) as although the speeds of the two emulsions are approximately equivalent, emulsion B has lower coating weight and crystal volume. In addition the emulsion B of this invention shows higher contrast.

Granularity is an objective measurement of the graininess observed in negatives and prints. The emulsion B of the invention shows superior speed to granularity ratio.

Further coated samples of emulsions A and B were photographically exposed through a continuous wedge to white light for 0.02 seconds and fully developed for 10 minutes in a developer (developer II) of the following formula at 20° C.:

| | |
|---|---|
| Metol | 2 gm |
| Hydroquinone | 8 gm |
| Sodium Sulphite, anhydrous | 90 gm |
| Sodium Carbonate, anhydrous | 45 gm |
| Potassium Bromide | 5 gm |
| Water to make | 1 liter |

The results were as follows:

| Emulsion | Silver Coating Weight ($mg/dm^2$) | Median crystal volume ($microns^3$) | Speed | Contrast | Efficiency |
|---|---|---|---|---|---|
| Emulsion A (comparative example) | 50 | 0.38 | 5.21 | 1.02 | 427000 |
| Emulsion B | 45 | 0.20 | 5.15 | 1.08 | 706000 |

Here 'efficiency' is the ratio ($10^{speed}$)/volume). It enables a comparison to be made of the photographic efficiency of emulsions of different crystal sizes.

These results show that Emulsion B of this invention has a higher efficiency in terms of speed to crystal volume at full development in developer II.

EXAMPLE 2

Preparation of tabular twinned octahedtral silver iodobromide emulsion.

Emulsion C - Emulsion of this invention

Preparation of a pyramidal monosized silver iodide emulsion (step a).

This was carried out as in emulsion B of example 1, except that a temperature of 50° C. was maintained for both stages.

The crystals had a mean diameter of 0.55 microns (based on a measurement of projected area).

Recrystallization (step b).

Approximately 19.30 g of the silver iodide emulsion grown in step a which contained 3.0 moles of silver iodide was stirred at 70° C. at 400 rpm in a stainless steel vessel. Tri-n-butyl orthophosphate was added as an antifoam.

180 g of 25% w/w aqueous inert gelatin was added. Aqueous solutions of 1.5 M silver nitrate and 1.5 M sodium bromide were jetted into the stirred silver iodide emulsion at rates (for the silver nitrate) increasing from 0.015 mole/min to 0.1125 mole/min over a period of 36.7 minutes until 2.25 moles of silver nitrate had been added.

184 g of 25% inert gelatin was added and further volumes of silver nitrate and sodium bromide solutions were jetted in at a rate (for the silver nitrate) of 0.15 mole/minute until 2.25 moles of silver nitrate had been added over a period of 15 minutes.

The pAg of the emulsion was maintained throughout at 9.2 (±0.1) by adjusting the flow rates of the bromide solution, and the temperature was maintained at 70° C. The emulsion had a mean crystal size of 0.70 microns (based on a measurement of projected surface area).

The yield was 7.5 moles of silver halide with an overall content of 40% silver iodide.

Further growth (step d).

Approximately 1860 g of the above mixed silver iodobromide emulsion which contained 1.5 moles of silver halide was stirred at 65° C. at 400 rpm in a stainless steel vessel. Tri-n-butyl orthophosphate was added as an antifoam. 320 g of 25% w/w aqueous inert gelatin was added.

Aqueous solutions of 1.5 M silver nitrate and 1.5 M sodium bromide were jetted into the stirred silver iodobromide emulsion at rates (for the silver nitrate) increasing from 0.1125 mole/minute to 0.12 mole/minutes over a period of 21 minutes, until 2.5 moles of silver nitrate had been added.

The pAg of the emulsion was maintained throughout at 9.16 (±0.1) by adjusting the flow rates of the bromide solution. The temperature was maintained at 65° C.

The crystals of the final emulsion had a mean diameter of 1.02 microns (based on a measurement of projected surface area) or 0.89 microns (based on a measurement of volume). The overall proportion of silver iodide was 15% of the total silver halide and the yield was 4.0 moles of silver halide.

What we claim is:

1. A method of preparing a silver halide emulsion wherein the silver halide crystals are of the twinned type which comprises the steps of (a) providing in a colloid dispersing medium silver halide seed crystals containing at least 90% iodide and at least 80% of which are of hexagonal lattice structure with each displaying predominantly a single basal face, (b) mixing in the dispersing medium containing the said silver halide seed crystals an aqueous solution of an alkali metal or ammonium bromide or chloride (or mixtures thereof) so forming twinned silver halide crystals containing iodide and the halide or halides being added, and (c) continuing the addition of said silver halide until dissolution of said seed crystals is substantially complete.

2. The method of claim 1 further comprising the step of:

adding a silver halide solvent to the dispersing medium and so causing the growth of the twinned silver halide crystals.

3. The method of claim 1 or 2 further comprising the step of:

(d) causing the twinned crystals to increase in size by adding to the colloid dispersing medium further aqueous silver salt solution and further alkali metal or ammonium halide.

4. The method of claim 3 further comprising the step of:

(e) removing the water-soluble salts formed and chemically sensitizing the silver halide crystals.

5. A method according to claim 1 wherein step (a) the pI is less than 1.5 and the temperature of the dispersion is maintained between 30° and 90° C.

6. A method according to claim 5 wherein the pI in step (a) is maintained at about 1.

7. A method according to claim 6 wherein the temperature in step (a) is maintained between 35° to 70° C.

8. A method according to claim 1 wherein the mean size of the silver iodide seed crystals formed in step (a) is from 0.05 to 2 microns.

9. A method according to claim 8 wherein the mean size of the seed silver iodide crystals formed in step (a) is from 0.15 to 1.0 microns.

10. A method according to claim 6 wherein sufficient alkali metal iodide is added to the dispersing medium to provide a pI of about 1 before the water soluble silver salt and the alkali metal or ammonium iodide are added to the dispersing medium.

11. A method according to claim 10 wherein the water soluble silver salt and the alkali metal or ammonium iodide are double jetted into the dispersion medium which comprises some alkali metal iodide.

12. A method according to claim 1 where in step (b) the temperature of the aqueous medium is from 35° to 70° C and the pAg is maintained between 6 and 10.

13. A method according to claim 1 wherein the mole % iodide content of the twinned silver halide crystals after step (b) is between 30 and 40.

14. A method according to claim 1 wherein the mole % iodide content in the silver halide crystals after step (d) is from 0.1 to 25%.

15. A method according to claim 14 wherein the mole % iodide content in the silver halide crystals after step (d) is from 5 to 20%.

16. A method according claim 1 where both in steps (b) and (d) the soluble silver salt and the alkali metal or ammonium halide are added to the dispersion medium by a double jetting method.

17. A method according to claim 1 where in step (b) the addition rates of the silver and halide solutions are predetermined by experiment.

18. A method according to claim 1 where in step (b) is carried out in the presence of a polyalkene oxide wetting agent.

19. A photographic silver halide emulsion which has been prepared by the method claimed in claim 1.

20. Photographic material which comprises in at least one photosensitive layer at least one emulsion as claimed in claim 19.

21. The method of claim 1 or 2 further comprising the step of removing the water-soluble salts formed and chemically sensitizing the halide crystals.

22. The method of claim 1 or 2 wherein said step (a) comprises forming said crystals in said dispersing medium.

* * * * *